US009308400B2

(12) United States Patent
Cavaliere et al.

(10) Patent No.: US 9,308,400 B2
(45) Date of Patent: Apr. 12, 2016

(54) INDICATOR ARRANGEMENT, REGULATOR RELEASE BUTTON, AND BREATHING APPARATUS

(75) Inventors: Mark L. Cavaliere, Pittsburgh, PA (US); Christopher L. Prete, Cranberry Township, PA (US); Michael F. Becker, Wexford, PA (US); Carsten Leuschner, Berlin (DE)

(73) Assignee: MSA Technology, LLC, Cranberry Township, PA (US)

( * ) Notice: Subject to any disclaimer, the term of this patent is extended or adjusted under 35 U.S.C. 154(b) by 937 days.

(21) Appl. No.: 13/174,976

(22) Filed: Jul. 1, 2011

(65) Prior Publication Data

US 2012/0000465 A1 Jan. 5, 2012

Related U.S. Application Data

(60) Provisional application No. 61/360,665, filed on Jul. 1, 2010.

(51) Int. Cl.

| | |
|---|---|
| ***A62B 9/04*** | (2006.01) |
| ***A62B 9/00*** | (2006.01) |
| ***A62B 7/04*** | (2006.01) |

(52) U.S. Cl.

CPC .. *A62B 9/04* (2013.01); *A62B 9/006* (2013.01)

(58) Field of Classification Search

CPC ... A61M 16/00; A61M 16/04; A61M 16/047; A61M 16/06–16/0694; A61M 2016/0661; A62B 7/00; A62B 7/02–7/14; A62B 9/00; A62B 9/04; A62B 9/003–9/027; A62B 18/00; A62B 18/02; A62B 18/04; A62B 18/06; A62B 18/08–18/088; B63C 11/18

USPC ..... 128/200.24, 201.22–202.11, 204.18, 128/204.21, 204.23, 204.26, 205.22, 128/205.23–205.25, 206.21, 207.12; 405/185; 455/575.2; 116/279, DIG. 5; 362/103–108, 570

See application file for complete search history.

(56) References Cited

U.S. PATENT DOCUMENTS 3,472,986 A * 10/1969 Stallman ..... 200/313
4,910,652 A * 3/1990 Rhine ..... 362/234

(Continued)

FOREIGN PATENT DOCUMENTS

| | | |
|---|---|---|
| EP | 0428131 A2 | 5/1991 |
| WO | 9719726 A2 | 6/1997 |
| WO | 0215978 A2 | 2/2002 |

OTHER PUBLICATIONS

Mine Safety Appliances Co., "Firehawk Second Stage Regulator," p. 3, 2008, http://webapps.msanet.com/care/SCBAManuals.html (updated publication).

(Continued)

*Primary Examiner* — Jason Flick
*Assistant Examiner* — Ned T Heffner
(74) *Attorney, Agent, or Firm* — The Webb Law Firm

(57) ABSTRACT

An indicator arrangement for a regulator removably connectable to a facemask in a breathing apparatus, the indicator arrangement including: at least one release button comprising a body operationally engaged with at least one component of the regulator and configured to be actuated by a user to detach the regulator from the facemask, wherein at least a portion of the body is configured to facilitate transmission of light from at least one light source; and wherein the light is visible on or through at least one external surface of the body of the at least one release button. A regulator release button and breathing apparatus are also disclosed.

17 Claims, 5 Drawing Sheets

(56) References Cited

U.S. PATENT DOCUMENTS

| | | | | |
|---|---|---|---|---|
| 5,097,826 | A | 3/1992 | Gray et al. | |
| 5,285,038 | A * | 2/1994 | Asher et al. | 200/314 |
| 5,781,118 | A | 7/1998 | Wise et al. | |
| 6,091,331 | A * | 7/2000 | Toft et al. | 340/539.11 |
| 6,899,101 | B2 * | 5/2005 | Haston et al. | 128/204.26 |
| 2002/0139371 | A1 | 10/2002 | Prete et al. | |
| 2003/0234018 | A1 | 12/2003 | Haston et al. | |
| 2009/0277763 | A1 * | 11/2009 | Kyowski et al. | 200/314 |

OTHER PUBLICATIONS

Mine Safety Appliances Co., "MSA FireHawk M7 Air Mask," 2008 http://www.msanorthamerica.com/catalog/product501697.html (updated publication).

Mine Safety Appliances Co., "Fire Hawk Air Mask Operation and Instructions," p. 15, 2009, http://www.msanorthamerica.com/catalog/product501697.html (updated publication).

* cited by examiner

INDICATOR ARRANGEMENT, REGULATOR RELEASE BUTTON, AND BREATHING APPARATUS

CROSS REFERENCE TO RELATED APPLICATIONS

This application claims the benefit of priority from Provisional Patent Application No. 61/360,665, filed Jul. 1, 2010, the contents of which are incorporated herein in its entirety.

BACKGROUND OF THE INVENTION

1. Field of the Invention

The present invention relates generally to breathing apparatuses, such as a self-contained breathing apparatus and system, and in particular to an indicator arrangement, regulator release button, and breathing apparatus where the regulator is detachable from a facemask in the breathing apparatus.

2. Description of the Related Art

In the field of firefighting, rescue operations, underwater activities, and other activities that occur in dangerous or specific environments, a breathing apparatus is often required in order to permit a person to safely and continually breathe. Accordingly, such a person will don and utilize a breathing apparatus, such as a self-contained breathing apparatus (SCBA), in a variety of contaminated or other irrespirable environments or conditions.

As is known, a self-contained breathing apparatus often includes a frame that securely holds and supports one or more air tanks, and each air tank includes at least one air hose that supplies air or oxygen to the user. In particular, the air hose provides fluid communication between the air tank and the user through a pressure regulator, which regulates the pressure and flow of air or oxygen to the user. The frame and air tank are removably attachable to the user using some connection arrangement, such as a harness, shoulder straps, or the like. Further, in certain environments, such as in a firefighting incident, the user will wear a full facemask that substantially covers the user's face area. The regulator is attached or attachable to a lower portion of such a facemask.

In many cases, a firefighter (or other user of the breathing apparatus) when situated away from the dangerous or irrespirable environment, will desire to remove the regulator and breathe fresh air. Therefore, the regulator can be detachable from the facemask using one or more actuatable buttons that permit quick and easy removal of the regulator. Accordingly, and when desired, the user can simply press the buttons and manipulate the regulator such that it is detached from the facemask.

In the firefighting field, as well as in connection with other dangerous activities, there are certain standards and regulations that require the use of a personal alert safety system (PASS) that automatically activates an alarm or other indicator if the user becomes incapacitated or is not moving for a specified period of time. For example, a flashing light or other indicator will activate so that others in the environment can assist the incapacitated or immobile user. As is known, the indicator (alarm) light is normally situated on the user's SCBA, such as on a connection arrangement that facilitates attachment of the frame (and air tank) to the user. However, such positioning can often lead to the user inadvertently blocking his or her indicator based upon movement, activity, arm positioning, or other similar condition. If the other users in the area cannot see the flashing indicator light, they would not know which user's alarm had been activated.

In most environments where a breathing apparatus is utilized, communication between users or between the user and a remotely-situated controller or person is paramount. For example, a remotely-situated person, such as a commander at the scene of a fire incident, may need to quickly communicate with all firefighters in a certain area, and require that they evacuate or move to a different location. While certain breathing apparatuses facilitate such communication through a display on the facemask, this display may become non-functional or depending upon its location, otherwise obscured. Similarly, certain breathing apparatuses and systems do not include such a facemask display, and rely upon other communication devices and arrangements to facilitate wireless communication between users and/or control personnel.

As set forth in U.S. Pat. No. 5,097,826, certain lights can be used in connection with a regulator in a self-contained breathing apparatus. However, there remains a need in the field of firefighting and other similar activities that require the use of a breathing apparatus for additional and enhanced safety features and beneficial communication functionality.

SUMMARY OF THE INVENTION

Therefore, and generally, the present invention provides an indicator arrangement, regulator release button, and breathing apparatus that addresses or overcomes some or all of the drawbacks associated with known breathing apparatuses. Preferably, the present invention provides an indicator arrangement, regulator release button, and breathing apparatus that provide effective awareness and positive indications regarding the status of a user of the breathing apparatus. Preferably, the present invention provides an indicator arrangement, regulator release button, and breathing apparatus that facilitate communication between users of the breathing apparatuses, or between such users and certain control personnel. Preferably, the present invention provides an indicator arrangement, regulator release button, and breathing apparatus that takes into consideration existing design components and constraints associated with a regulator (or other components) of a breathing apparatus, such as a self-contained breathing apparatus.

Accordingly, and in one preferred and non-limiting embodiment, provided is an indicator arrangement for a regulator removably connectable to a facemask in a breathing apparatus. The indicator arrangement includes at least one release button comprising a body operationally engaged with at least one component of the regulator and configured to be actuated by a user to detach the regulator from the facemask, wherein at least a portion of the body is configured to facilitate transmission of light from at least one light source. The light is visible on or through at least one external surface of the body of the release button.

In another preferred and non-limiting embodiment, provide is a release button for a regulator removably connectable to a facemask in a breathing apparatus. The release button includes a body operationally engaged with at least one component of the regulator and configured to be actuated by a user to detach the regulator from the facemask. At least a portion of the body is at least partially translucent, such that light generated by at least one light source is transmitted through at least a portion of the body and visible on or through at least one external surface of the body.

In a further preferred and non-limiting embodiment, provided is a breathing apparatus, including: a frame for supporting an air tank having at least one air tube extending therefrom; a connection arrangement for removably attaching the frame to a user; a facemask configured for removable attachment to the head of the user; a regulator attachable to the facemask and in fluid communication with the air tank via the at least one air tube; at least one release button having a body operationally engaged with at least one component of the regulator and configured to be actuated by the user to detach the regulator from the facemask, wherein at least a portion of the body is configured to facilitate transmission of light from at least one light source, such that the light is visible on or through at least one external surface of the body of the release button.

These and other features and characteristics of the present invention, as well as the methods of operation and functions of the related elements of structures and the combination of parts and economies of manufacture, will become more apparent upon consideration of the following description and the appended claims with reference to the accompanying drawings, all of which form a part of this specification, wherein like reference numerals designate corresponding parts in the various figures. It is to be expressly understood, however, that the drawings are for the purpose of illustration and description only and are not intended as a definition of the limits of the invention. As used in the specification and the claims, the singular form of "a", "an", and "the" include plural referents unless the context clearly dictates otherwise.

DETAILED DESCRIPTION OF THE PREFERRED EMBODIMENT(S)

Figure 1:
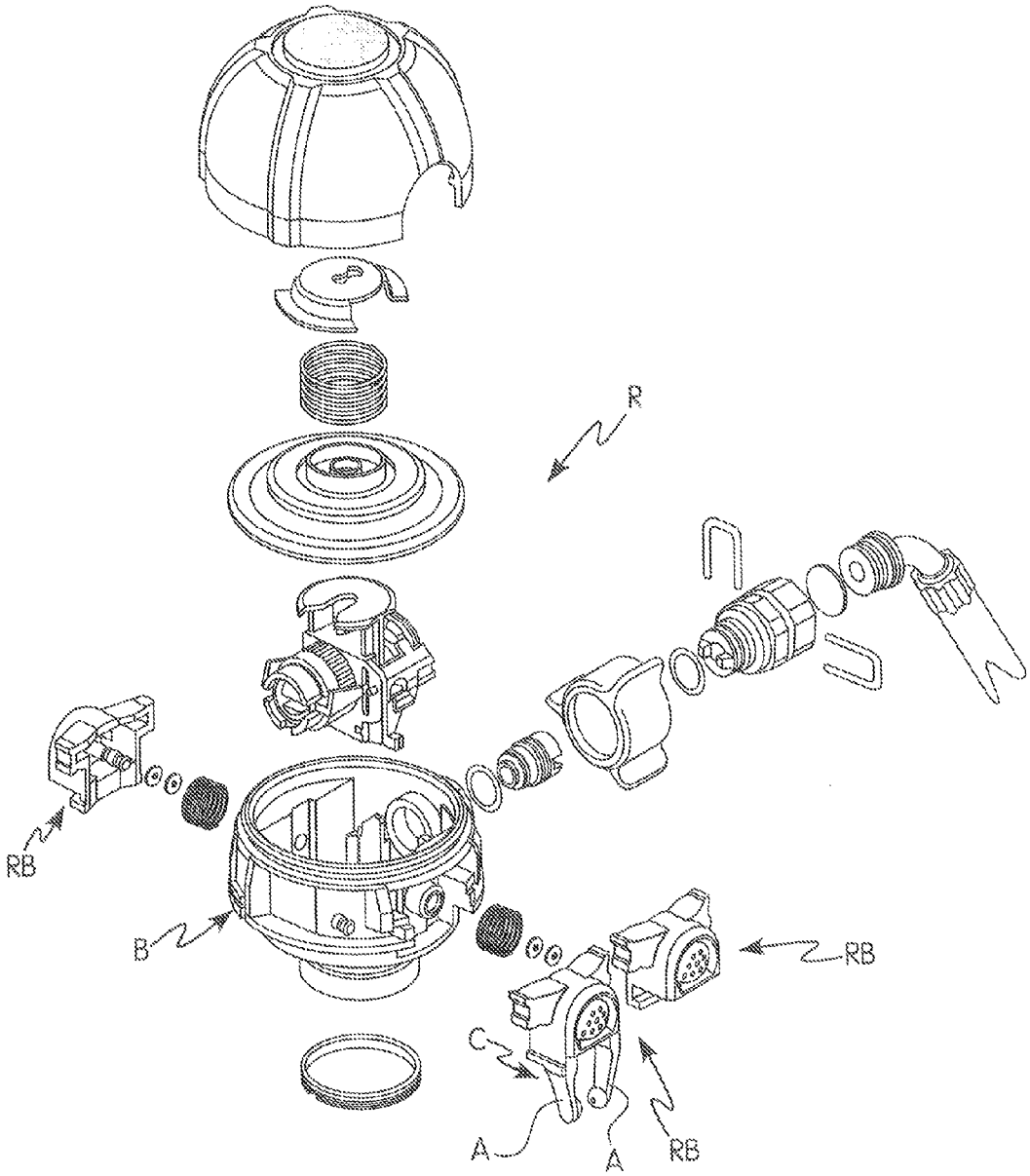
FIG. 1 (Prior Art)
FIG. 1 is an exploded, perspective view of a Firehawk® CBRN Mask Mounted Regulator currently available from Mine Safety Appliances Company, Pittsburgh, Pennsylvania.

For purposes of the description hereinafter, the terms "end", "upper", "lower", "right", "left", "vertical", "horizontal", "top", "bottom", "lateral", "longitudinal" and derivatives thereof shall relate to the invention as it is oriented in the drawing figures. However, it is to be understood that the invention may assume various alternative variations and step sequences, except where expressly specified to the contrary. It is also to be understood that the specific devices and processes illustrated in the attached drawings, and described in the following specification, are simply exemplary embodiments of the invention. Hence, specific dimensions and other physical characteristics related to the embodiments disclosed herein are not to be considered as limiting. Further, it is to be understood that the invention may assume various alternative variations and step sequences, except where expressly specified to the contrary.

As discussed above, there exists a variety of breathing apparatuses, e.g., self-contained breathing apparatus, and similar systems, some of which are available through Mine Safety Appliances Company. Further, the various components of the breathing apparatus can be provided together or separately, and one of these components is the regulator R. With reference to FIG. 1, which illustrates the presently-available Firehawk® Mask Mounted Regulator, this regulator R is removable or detachable from a facemask (not shown in FIG. 1) through the use of two release buttons RB. These spring-based release buttons RB are positioned on either side of a body B of the regulator R. As discussed hereinafter, by actuating these release buttons RB, the user may attach or detach the regulator R from the facemask.

One optional feature illustrated in the regulator R shown in FIG. 1 is a secondary latching system that includes a clip portion C on one of the release buttons RB. This variation is shown side-by-side with a release button RB that does not include such a secondary latching arrangement. This clip portion C includes two arms A that extend from a body of the release button RB and, as discussed hereinafter, interact with a rail attached to and extending from a facemask.

Figure 2:
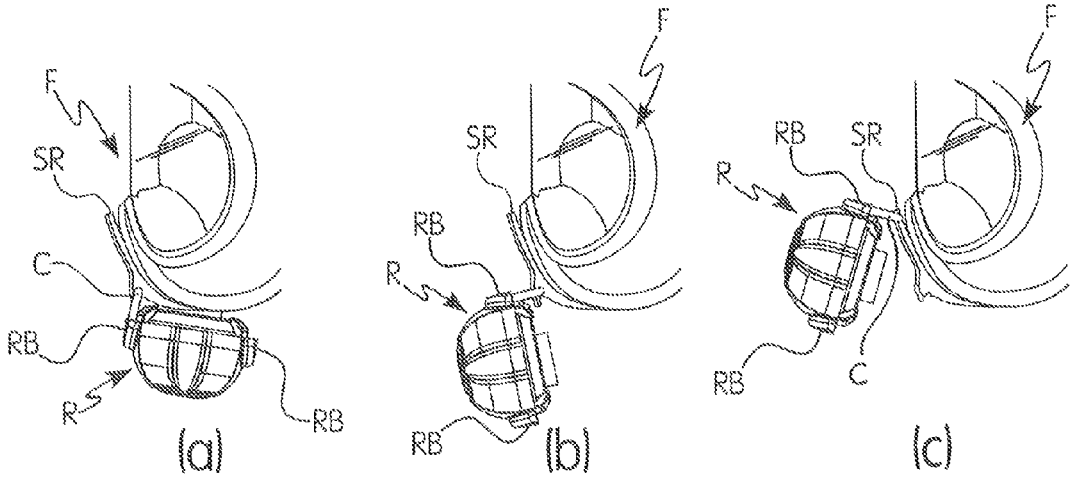
FIG. 2 (Prior Art)
FIGS. 2(*a*)-(*c*) are side views of a regulator being detached from a facemask in a known breathing apparatus.

FIGS. 2(*a*)-(*c*) illustrate the steps for detaching the regulator R from the facemask F, which, when performed in reverse order, allows for the reattachment of the regulator R to the facemask F. As seen in FIG. 2(*a*), the user actuates both release buttons RB and pulls the regulator R down and away from the facemask F. At this point, and as illustrated in FIG. 2(*b*), the regulator R can hang from the facemask F through the interaction between the arms A of the clip portion C of the regulator R and a slide rail SR attached to the facemask F. Finally, in order to fully remove the regulator R from the facemask F, the clip portion C is slid up the slide rail SR until the arms A are free from contact and interaction with the slide rail SR, as shown in FIG. 2(*c*). In this manner, the regulator R can be fully removed from the facemask F.

Figure 3:
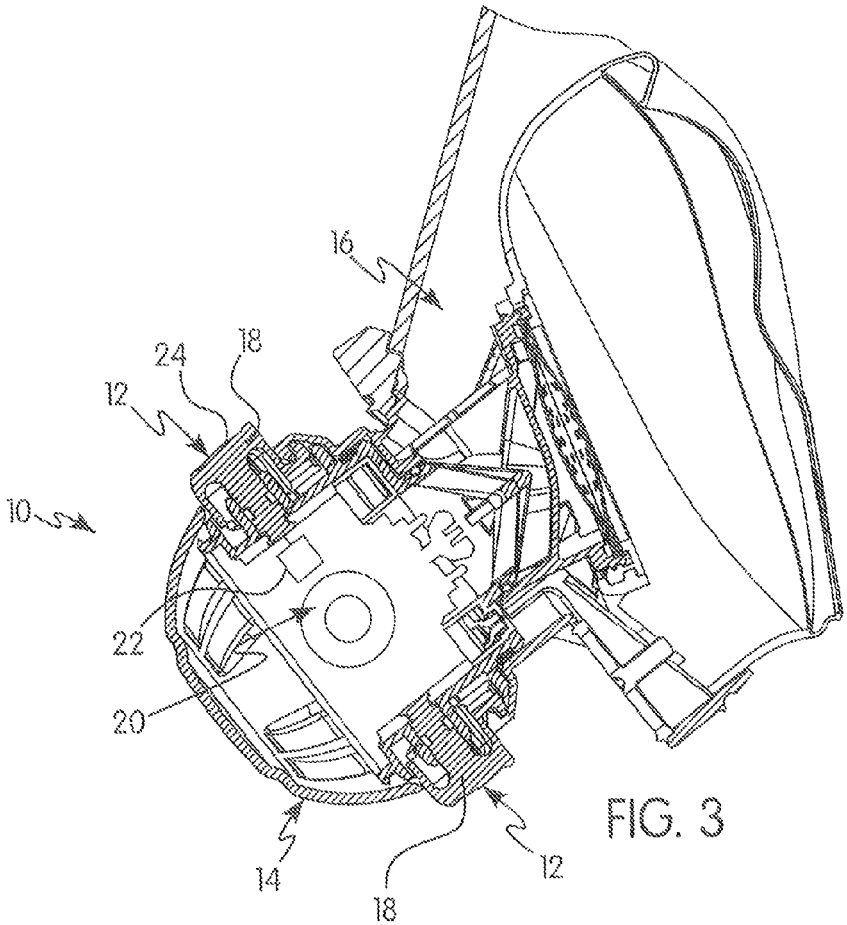
FIG. 3 is a side, sectional view of an indicator arrangement, regulator, and facemask according to the principles of the present invention.

As shown in FIG. 3, the present invention includes an indicator arrangement 10, a release button 12, and a facemask 16. Further, the indicator arrangement 10 and release button 12 are for use specifically in connection with a regulator 14 that is detachable and/or removable from the facemask 16.

The indicator arrangement 10 includes at least one release button 12 having a body 18 that is operationally engaged with at least one internal component 20 of the regulator 14. In particular, and as discussed above, the release button 12 can be spring-based or otherwise facilitate interaction between a portion of the release button 12 and the internal components 20 of the regulator 14, such that the release button 12 can be actuated by a user and the regulator 14 detached from the facemask 16. While two release buttons 12 are illustrated in FIG. 3, it is envisioned that the regulator 14 can be detached and attached using only a single release button 12 or similar actuatable structure through some interaction between the body 18 of the release button 12 and one or more of the internal components 20 of the regulator 14.

Figure 4:
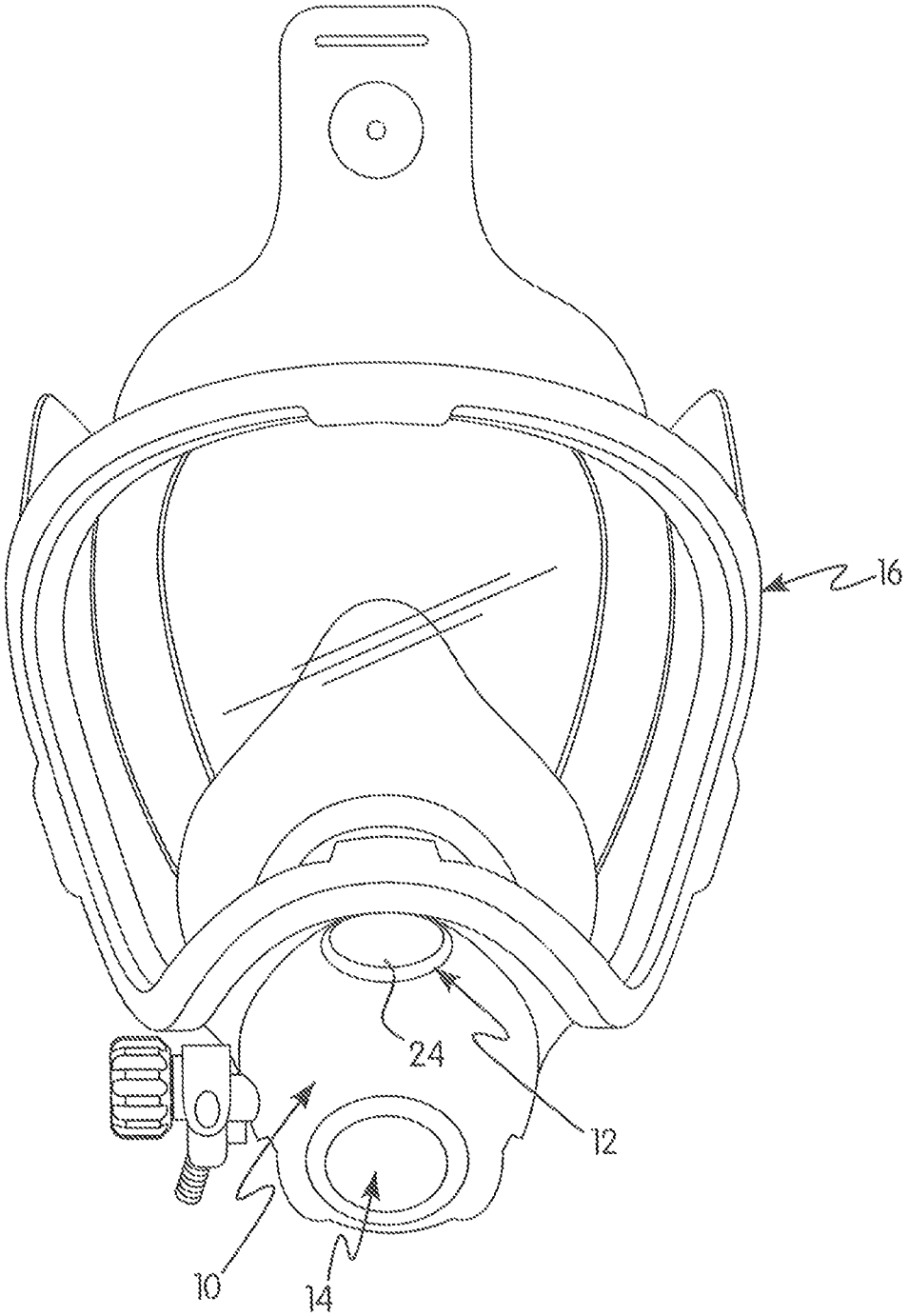
FIG. 4 is a front view of the indicator arrangement, regulator, and facemask of FIG. 3.

In one preferred and non-limiting embodiment, the indicator arrangement 10 further includes at least one light source 22 that is adapted or configured to generate light (or light waves) for transmission towards or through at least a portion of the body 18 of the release button 12. By doing so, the light is visible on or through at least one external surface 24 of the body 18 of the release button 12. Again, while it is illustrated that the indicator arrangement 10 is only used in connection with one of the two release buttons 12, it is envisioned that the light source 22 may generate and transmit light towards or through both of the release buttons 12. A front view of the indicator arrangement 10, release button 12 (as activated), and the facemask 16 is illustrated in FIG. 4. It is further envisioned that the indicator arrangement 10 can be configured to harness, use, or focus the external (or ambient) light as the light source. Accordingly, the various embodiments and configurations (as discussed hereinafter) of the indicator arrangement 10 and release button 12 can be used in connection with this external light source 22 or level, which can take the place of or augment an artificial light source 22.

Figure 5:
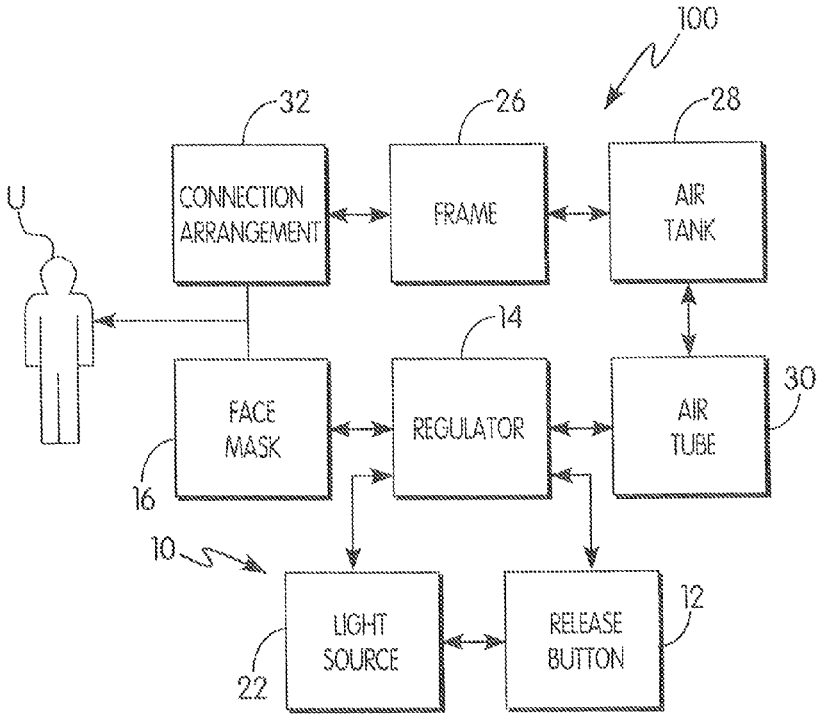
FIG. 5 is a schematic view of one embodiment of a breathing apparatus according to the principles of the present invention.

As discussed above, the present invention also is directed to a breathing apparatus 100, which is illustrated in schematic form in FIG. 5. In this breathing apparatus 100, the above-discussed regulator 14 and facemask 16 are used in connection with a user U. Further, the indicator arrangement 10, including the release button 12 and light source 22, comprises part of the regulator 14.

The breathing apparatus 100 further includes a frame 26 for supporting an air tank 28, which is filled with oxygen, air, or the like. In addition, multiple air tanks 28 can be used in connection with the frame 26. The air tank 28 includes at least one air tube 30 extending therefrom, typically through a regulator 14 or similar control device positioned on the air tank 28. As is known in the art, other electronics, conduits, and components can be used in the generation and transmission of air or oxygen throughout the various portions of the breathing apparatus 100.

A connection arrangement 32 is provided and facilitates the removable attachment of the frame 26 (and, thus, the air tank 28) to the user U. The above-discussed facemask 16 is removably attachable to the head of a user U, and the regulator 14 is removably attachable to the facemask 16. Further, the regulator 14 is in fluid communication with the air tank 28 via the air tube 30.

Figure 6:
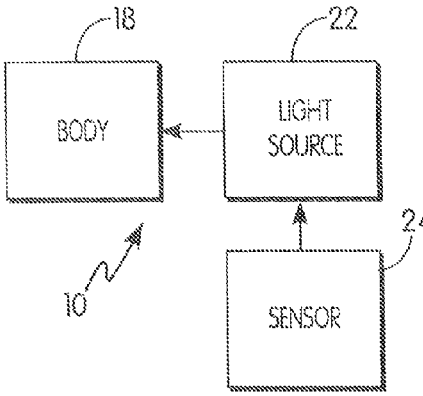
FIG. 6 is a schematic view of one embodiment of an indicator arrangement according to the principles of the present invention.

In a further embodiment, and as illustrated in FIG. 6, at least one sensor 34 can be provided on or in connection with the release button 12, body 18, and/or regulator 14 (such as within the regulator 14). The sensor 34 is configured or operable to sense an external light level and generate signals based upon the external light level. This sensor 34 is in communication with the light source 22, and the light source 22 is adjustable based upon the signals received from the sensor 34. In this manner, the intensity of the light generated by the light source 22 can be automatically adjusted based upon the external conditions, e.g., nighttime, daytime, smoky or obscured environment, or the like. Further, the information and output from the sensor 34 can be used to activate or deactivate an artificial light source 22 in favor of using the external (or ambient) light level as a natural (environmental) light source 22.

Figure 7:
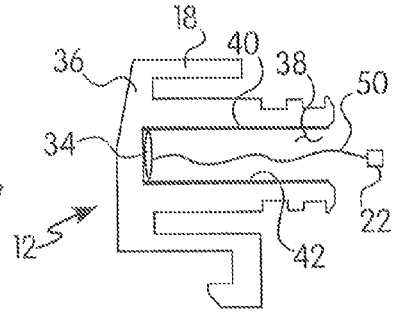
FIG. 7 is a side, sectional view of another embodiment of an indicator arrangement according to the principles of the present invention.

Various preferred and non-limiting embodiments of the release button 12 according to the present invention are shown in FIGS. 7-14. With reference to FIG. 7, at least a portion of the body 18 is at least partially translucent, thereby facilitating the passage of light generated by the light source 22 and projected towards the body 18 (or generated by the external (or ambient) light). Accordingly, at least one external wall 36 is translucent, and in this embodiment, the sensor 34 is positioned at or near the end of an internal channel 38 through which the light generated by the light source 22 is transmitted.

In this embodiment, the internal channel 38 can be used as a conduit for one or more wires 50 associated with the sensor 34. Still further, in this embodiment, an internal surface 40 of the internal channel 38 is coated with a reflective material 42 which facilitates the concentration and transmission of the light generated by the light source 22. Additionally, in this embodiment, the light source 22 is located at least partially within the regulator 14, but positioned in such a manner as to effectively transmit light through the internal channel 38 towards the external wall 36 of the body 18 of the release button 12.

Figure 8:
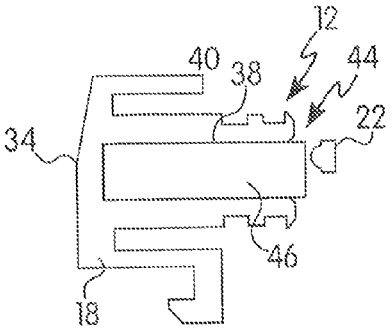
FIG. 8 is a side, sectional view of a further embodiment of an indicator arrangement according to the principles of the present invention.

In the preferred and non-limiting embodiment of FIG. 8, the light source 22 is in the form of one or more light emitting diodes (LEDs), which are positioned near or adjacent a first end 44 of the internal channel 38. Further, a light pipe 46 is positioned at least partially within the internal channel 38 and facilitates the reflection and/or transmission of light from the light source 22 through the body 18. At least a portion of the body 18 is translucent, such that the light is visible on or through an external surface 24 of the body 18.

Figure 9:
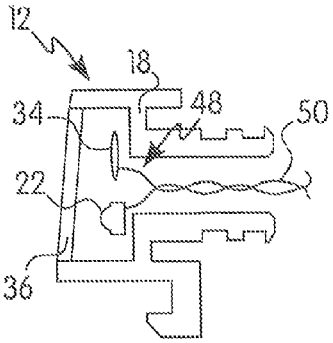
FIG. 9 is a side, sectional view of a still further embodiment of an indicator arrangement according to the principles of the present invention.

In the preferred and non-limiting embodiment of FIG. 9, the majority of the body 18 is formed from a normal (generally opaque) material, while the external wall 36 (which is the "top" of the release button 12) is translucent. Further, both the sensor 34 and the light source 22 (again, which may be in the form of one or more LEDs) is located near or adjacent to a second end 48 of the internal channel 38. In this embodiment, as with the embodiment of FIG. 7, the internal channel 38 is used to provide a conduit for one or more wires 50 for data or electrical transmission therethrough.

Figure 10:
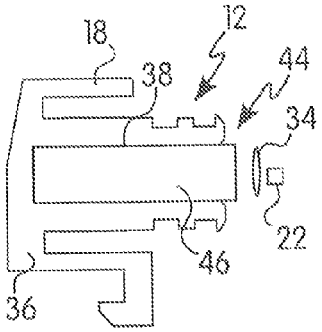
FIG. 10 is a side, sectional view of another embodiment of an indicator arrangement according to the principles of the present invention.
Figure 11:
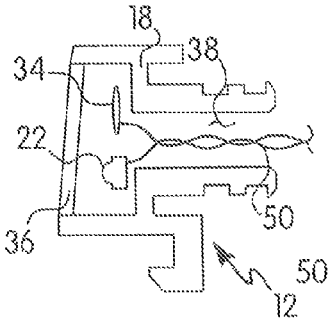
FIG. 11 is a side, sectional view of a further embodiment of an indicator arrangement according to the principles of the present invention.

FIG. 10 illustrates a further preferred and non-limiting embodiment of the release button 12 where a light pipe 46 is positioned within the internal channel 38 in the body 18. However, in this embodiment, the sensor 34 is positioned at or near the first end 44 of the internal channel 38. With reference to FIG. 11, this preferred and non-limiting embodiment is similar to FIG. 9 with respect to the external wall 36 and positioning of the sensor 34 and light source 22. However, in this embodiment, the light source 22 is in the form of a dual-colored LED, such as an alternating red/green colored light.

Of course, it is envisioned that the artificial light source 22 can take a variety of forms and generate flashing lights, colored lights, alternating colored lights, or any other similar pattern or display. Any such pattern or display can be chosen based upon what information is or should be provided to the user U or any of the other users in the vicinity. For example, a certain colored light or pattern can be used to call the user U back to a remote location (or out of the present environment), while another pattern or color could be used if the user U is in distress or has otherwise become immobile or incapacitated.

In this manner, the user U, as well as other users in the vicinity, can readily obtain immediate information on the conditions, such that response time can be minimized.

Figure 12:
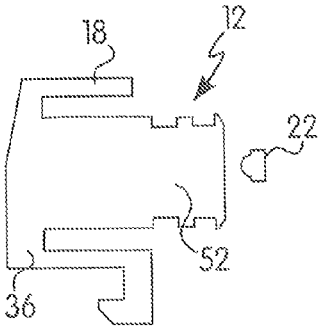
FIG. 12 is a side, sectional view of a still further embodiment of an indicator arrangement according to the principles of the present invention.

In a further preferred and non-limiting embodiment, and as illustrated in FIG. 12, the entire body B of the release button 12 can be translucent, such that the light source 22 generates light that is transmitted through the entire body 18, including the external wall 36. Therefore, in this embodiment, there is no internal channel 38 provided, and instead, the light source 22 is positioned adjacent or near to a first end 52 of the body 18.

Figure 13:
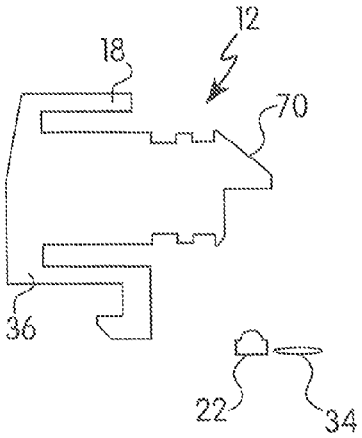
FIG. 13 is a side, sectional view of another embodiment of an indicator arrangement according to the principles of the present invention.

In another preferred and non-limiting embodiment, as illustrated in FIG. 13, the release button 12 includes an angle member 70. This angle member 70 is used to reflect light from the light source 22 through the body 18 of the button 12. In addition, the angle member 70 can be configured to reflect the light at a variety of specified angles. Still further, in this preferred and non-limiting embodiment of the release button 12, the above-discussed sensor 34 is included for use in connection with the light source 22. It is also envisioned that the angle member 70 can be configured to reflect light from the external (or ambient) light level, which may act exclusively as the light source 22, or augment the artificial light source 22.

Figure 14:
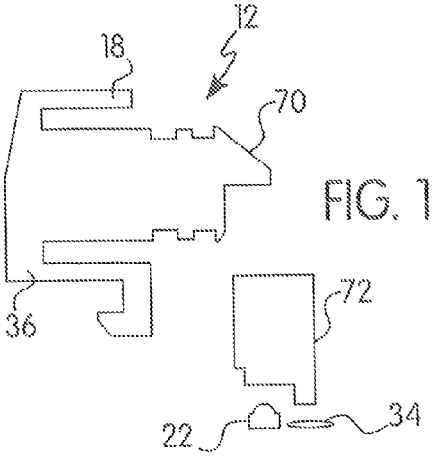
FIG. 14 is a side, sectional view of yet another embodiment of an indicator arrangement according to the principles of the present invention.

FIG. 14 illustrates a still further preferred and non-limiting embodiment of the release button 12, which includes the above-discussed angle member 70 (with all of the features and functionality discussed in connection with the angle member 70). However, in this embodiment, a separate light pipe 72 is provided. This light pipe 72 is configured to transmit or facilitate the transmission of light from the light source 22 (or the external (ambient) light level) to or towards the angle member 70. In particular, this separate light pipe 72 is configured to transmit or facilitate light transmission though the angle member 70 (and, thus, through the body 18) from greater distances and/or various positions or locations.

Figure 15:
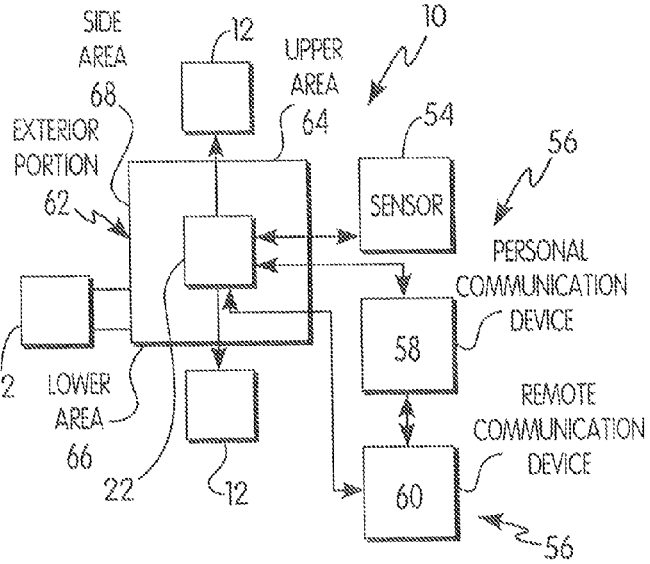
FIG. 15 is a schematic view of a portion of a breathing apparatus and an indicator arrangement according to the principles of the present invention.

Another preferred and non-limiting embodiment is shown in schematic form in FIG. 15. In this embodiment, the light source 22 is in communication with at least one sensor 54, which is configured or operable to sense motion (of the user U) and generate signals based thereon. Further, in this embodiment, the light source 22 is activated and generates light when the signals from the sensor 54 indicate a lack of motion for a specified period of time. As discussed above, the specific light color, pattern, intensity, or the like, may be different if a lack of motion of the user U is detected, as this would indicate a dangerous or unsafe condition.

In the embodiment of FIG. 15, the indicator arrangement 10 is used in connection with the communication systems associated with the user U. In particular, the light source 22 may be in communication with a communication device 56, where the light source 22 will activate and generate light based upon signals received directly or indirectly from the communication device 56. In one embodiment, the communication device 56 is a personal communication device 58 (e.g., a user-worn radio or the like), which is positioned on or near the user U of the breathing apparatus 100, and in another embodiment, the communication device 56 is a remote communication device 60 that is positioned remote from the user U of the breathing apparatus 100. In addition, the personal communication device 58 may be in communication with the remote communication device 60, as is known in the art.

In operation, if the control personnel (or commander) would like the user U to evacuate or leave a specific area or cease engaging in a specific activity, this command or communication can be sent to the light source 22 (or some controller in communication with the light source 22) either directly or indirectly through the personal communication device 58. Accordingly, the communication device 56 may be in the form of or include a computing device or other apparatus capable of transmitting information and data either directly to the light source 22 or to some controller that is in communication with the light source 22.

If activated, and due to the incorporation of light source 22 with the release button 12 on the top of the regulator 14, the user U sees the activated release button 12 and knows to evacuate the area or cease engaging in a specific activity. As discussed above, the pattern, intensity, or nature of the light or activation of the release button 12 may be indicative of the content of the communication or the urgency thereof. Further, any required communication that can be understood from the pattern, intensity, or nature of the light projected from the light source 22 is envisioned within the context of the present invention.

As discussed above, in one preferred and non-limiting embodiment, the indicator arrangement 10 is used in connection with the release button 12 that is positioned in a variety of locations on the regulator 14. For example, and as further illustrated in FIG. 15, the release button 12, and specifically the body 18 of the release button 12, may be operationally positioned on an exterior portion 62 of the regulator 14, an upper area 64 of the exterior portion 62 of the regulator 14, and/or a lower area 66 of the exterior portion 62 of the regulator 14.

Alternatively, the release button 12 could be positioned on a side area 68 of the exterior portion 62 of the regulator 14. In one preferred and non-limiting embodiment, the release button 12 is positioned in a location on the regulator 14 that serves not only to allow for the efficient attachment and detachment of the regulator 14 from the facemask 16, but also in an area that provides easy cognition that an activation has occurred, whether by the user U or other personnel in the area.

In this manner, the present invention provides an indicator arrangement 10, release button 12, and breathing apparatus that allows for quick and efficient communication with both the user U, as well as others in the area or vicinity. For example, when the release button 12 activates or flashes, a firefighter knows that he or she must immediately return from the incident. In addition, the use of the indicator arrangement 10 allows other firefighters in an area to see if one of their team members has a problem with his or her breathing apparatus.

The present invention effectively integrates the operation and function of a release button and a "buddy" light. Therefore, when the release button 12 is positioned on an upper area 64 of the external portion 62 of the regulator 14, the release button 12 has two distinct functions, i.e., retaining the regulator 14 on the facemask 16, as well as providing an indicator or "buddy" light.

In one preferred and non-limiting embodiment, the electronics associated with the light source 22 are located inside the regulator 14, and the light source 22 may also be placed or located inside the regulator 14. This leads to the additional advantage of eliminating the need for wiring or other feed-through restrictions on the facemask while providing for the appropriate indication or activation of a warning or buddy light.

Therefore, the presently-invented indicator arrangement 10, release button 12, and breathing apparatus 100 provide a number of advantages over existing systems and arrangements, including: the use of one part, i.e., the release button 12, with two distinct functions; eliminating the need for a separate space or location for a "buddy" light; no feed-through on the facemask (which needs to be sealed); providing an optimal location for a "buddy" light directly in front of the user's U head; and minimization of the number of parts required to construct the regulator 14, e.g., extra wires, sealings, electronics board, a separate transparent/translucent window for the "buddy" light itself, and the like. These and other advantages and benefits are recognized through the implementation and use of the indicator arrangement 10, release button 12, and breathing apparatus 100 according to the present invention.

Although the invention has been described in detail for the purpose of illustration based on what is currently considered to be the most practical and preferred embodiments, it is to be understood that such detail is solely for that purpose and that the invention is not limited to the disclosed embodiments, but, on the contrary, is intended to cover modifications and equivalent arrangements that are within the spirit and scope of the appended claims. For example, it is to be understood that the present invention contemplates that, to the extent possible, one or more features of any embodiment can be combined with one or more features of any other embodiment.

The invention claimed is:

1. An indicator arrangement for a regulator removably connectable to a facemask in a breathing apparatus, the indicator arrangement comprising:

at least one release button comprising a body operationally engaged with at least one component of the regulator and configured to be actuated by a user to detach the regulator from the facemask, at least one light source, and at least one sensor in communication with the at least one light source, the at least one sensor configured to sense at least one condition and generate at least one signal based on the at least one condition to operate the at least one light source, wherein at least a portion of the body is configured to facilitate transmission of light from the at least one light source;

wherein the light is visible on or through at least one external surface of the body of the at least one release button to illuminate at least a portion of the at least one release button, wherein the at least one sensor is configured to sense an external light level and generate the at least one signal based thereon, and wherein the at least one sensor is configured to activate the at least one light source upon detecting a lack of motion of a user for a predetermined amount of time.

2. The indicator arrangement of claim 1, wherein the at least one light source is configured to adjust based upon the at least one signal received from the at least one sensor.

3. The indicator arrangement of claim 1, wherein the at least one light source comprises at least one light emitting diode.

4. The indicator arrangement of claim 1, wherein the light source is configured to generate at least one of the following: a flashing light, a colored light, an alternating colored light, or any combination thereof.

5. The indicator arrangement of claim 1, wherein the light source is positioned at least partially within the regulator.

6. The indicator arrangement of claim 1, wherein the at least one light source is in communication with a communication device and configured to activate and generate light based upon at least one communication signal received from the communication device.

7. The indicator arrangement of claim 1, further comprising a light pipe positioned at least partially spaced from the body and configured to facilitate the transmission of light from the light source through the body.

8. The indicator arrangement of claim 1, further comprising at least one angle member configured to reflect light from the at least one light source through the body at at least one specified angle.

9. The indicator arrangement of claim 1, wherein the at least one body is operationally positioned on at least one of the following: an exterior portion of the regulator; an upper area of the exterior portion of the regulator; a lower area of the exterior portion of the regulator, a side area of the exterior portion of the regulator, or any combination thereof.

10. The indicator arrangement of claim 1, wherein at least a portion of the body is at least partially translucent.

11. The indicator arrangement of claim 10, wherein at least one external wall of the body is translucent.

12. The indicator arrangement of claim 10, wherein substantially the entire body is translucent.

13. The indicator arrangement of claim 1, wherein the body defines at least one internal channel extending at least partially therethrough.

14. The indicator arrangement of claim 13, wherein a light pipe is positioned at least partially within the at least one internal channel and configured to facilitate the transmission of light from the light source through the body.

15. The indicator arrangement of claim 13, wherein at least a portion of the internal surface of the at least one internal channel comprises a reflective material.

16. A release button for a regulator removably connectable to a facemask in a breathing apparatus, the release button comprising:

a body operationally engaged with at least one component of the regulator and configured to be actuated by a user to detach the regulator from the facemask;

at least one light source; and at least one sensor in communication with the at least one light source, the at least one sensor configured to sense at least one condition and generate at least one signal based on the at least one condition to operate the at least one light source, wherein at least a portion of the body is at least partially translucent, such that light generated by the at least one light source is transmitted through at least a portion of the body and visible on or through at least one external surface of the body to illuminate at least a portion of the body, wherein the at least one sensor is configured to sense an external light level and generate the at least one signal based thereon, and wherein the at least one sensor is configured to activate the at least one light source upon detecting a lack of motion of a user for a predetermined amount of time.

17. A breathing apparatus, comprising:

a frame for supporting an air tank having at least one air tube extending therefrom;

a connection arrangement for removably attaching the frame to a user;

a facemask configured for removable attachment to the head of the user;

a regulator attachable to the facemask and in fluid communication with the air tank via the at least one air tube;

at least one release button comprising:

a body operationally engaged with at least one component of the regulator and configured to be actuated by the user to detach the regulator from the facemask, at least one light source, and at least one sensor in communication with the at least one light source, the at least one sensor configured to sense at least one condition and generate at least one signal based on the at least one condition to operate the at least one light source, wherein at least a portion of the body is configured to facilitate transmission of light from the at least one light source, such that the light is visible on or through at least one external surface of the body of the at least one release button to illuminate at least a portion of the body, wherein the at least one sensor is configured to sense an external light level and generate the at least one signal based thereon, and wherein the at least one sensor is configured to activate the at least one light source upon detecting a lack of motion of a user for a predetermined amount of time.

* * * * *